US009074799B2

(12) United States Patent
Abei et al.

(10) Patent No.: US 9,074,799 B2
(45) Date of Patent: Jul. 7, 2015

(54) COOLING-STORAGE TYPE HEAT EXCHANGER

(75) Inventors: Jun Abei, Obu (JP); Tomohiko Nakamura, Obu (JP); Hirofumi Futamata, Obu (JP); Toshiya Nagasawa, Obu (JP)

(73) Assignee: DENSO CORPORATION, Kariya (JP)

( * ) Notice: Subject to any disclaimer, the term of this patent is extended or adjusted under 35 U.S.C. 154(b) by 671 days.

(21) Appl. No.: 13/462,279

(22) Filed: May 2, 2012

(65) Prior Publication Data

US 2012/0285668 A1 Nov. 15, 2012

(30) Foreign Application Priority Data

May 10, 2011 (JP) ..... 2011-105439

(51) Int. Cl.
*F25B 39/04* (2006.01)

(52) U.S. Cl.
CPC ..... *F25B 39/04* (2013.01); *F25B 2339/042* (2013.01); *F25B 2500/06* (2013.01); *F25B 2500/14* (2013.01)

(58) Field of Classification Search
CPC . B60H 1/005; F28D 20/02; F28D 2020/0008; F28D 2020/0013; F28D 2021/0085; F25B 39/022; F28F 17/005; Y02E 60/145; Y02E 60/147
USPC ..... 165/175, 176, 71, 151; 62/285, 288
See application file for complete search history.

(56) References Cited

U.S. PATENT DOCUMENTS

2004/0093889 A1* 5/2004 Bureau et al. ..... 62/434
2007/0039714 A1* 2/2007 Loup et al. ..... 165/43
2010/0065244 A1* 3/2010 Yokoyama et al. ..... 165/10
2010/0307180 A1* 12/2010 Yamada et al. ..... 62/285
2011/0239696 A1 10/2011 Takagi
2012/0042687 A1* 2/2012 Kamoshida et al. ..... 62/524
2012/0204597 A1* 8/2012 Karl et al. ..... 62/529
2014/0318176 A1* 10/2014 Takagi ..... 62/524

FOREIGN PATENT DOCUMENTS

JP 61-006594 1/1986
JP 61-140791 6/1986
JP 2004-150710 5/2004
JP 2010-149814 7/2010
JP 2011-012947 1/2011

OTHER PUBLICATIONS

Office action dated Apr. 15, 2014 in corresponding Japanese Application No. 2011-105439.
Office Action dated Nov. 4, 2014 in corresponding Japanese Application No. 2011-105439.
Office action dated Dec. 27, 2013 in corresponding Chinese Application No. 201210138775.6.

* cited by examiner

*Primary Examiner* — Tho V Duong
(74) *Attorney, Agent, or Firm* — Harness, Dickey & Pierce, PLC

(57) ABSTRACT

Multiple cooling-storage containers are arranged in respective spaces formed between neighboring refrigerant tubes. The cooling-storage container is made of a pair of outer envelope portions, each forming a side wall. Multiple convex portions and concave portions are formed in the side walls so that air passages are formed between refrigerant tubes and the concave portions. A sectional area of the air passage formed in a lower portion of the cooling-storage container below a predetermined height is made larger than that of the air passage formed in an upper portion of the cooling-storage container above the predetermined height.

10 Claims, 14 Drawing Sheets

COOLING-STORAGE TYPE HEAT EXCHANGER

CROSS REFERENCE TO RELATED APPLICATION

This application is based on Japanese Patent Application No. 2011-105439 filed on May 10, 2011, the disclosure of which is incorporated herein by reference.

TECHNICAL FIELD

The present disclosure relates to a cooling-storage type heat exchanger, which is used, for example, in a refrigerating cycle for a vehicle.

BACKGROUND

A cooling-storage type heat exchanger is already known in the art, for example, as disclosed in Japanese Patent Publication No 2011-012947 (A). The heat exchanger of this kind is composed of multiple refrigerant tubes, which extend in a vertical direction and form refrigerant passages therein, and multiple cooling-storage containers arranged between neighboring refrigerant tubes.

In the above heat exchanger, convex portions and concave portions are formed in side plates of the cooling-storage container and they are alternately arranged in the vertical direction. The cooling-storage containers are fixed to the refrigerant tubes at the convex portions, which are formed at equal pitches in the vertical direction. The cooling-storage container is separated from the refrigerant tubes at the concave portions to form air passages, through which outside air (which cools down, for example, a passenger compartment of a vehicle) in a cold-energy storing operation or a cold-energy discharging operation. In the cold-energy storing operation, liquid-phase refrigerant flowing through the refrigerant passages is vaporized so that heat is absorbed from the outside air and cooling-storage material contained in the respective cooling-storage containers. In the cold-energy discharging operation, the cold-energy stored in the cooling-storage material is discharged to the outside air passing through the heat exchanger. The air passages, which are formed between the refrigerant tubes and the concave portions, are also used as a space for discharging condensed water, which is generated in the cold-energy storing operation for the cooling-storage material.

In the above heat exchanger, the condensed water is likely to remain in a lower portion thereof, when the condensed water is generated in the cold-energy storing operation for the cooling-storage material and the condensed water flows in a downward direction (in a gravity direction). In addition, the condensed water may not be easily discharged from the air passages formed between refrigerant tubes and the concave portions of the cooling-storage containers, and thereby the condensed water may be filled therein to cover the air passages. In addition, the refrigerant, which flows through the refrigerant passages, are likely to stay in the gravity direction (that is, in a lower portion of the refrigerant passage in the vertical direction). Therefore, temperature of the refrigerant tubes in a lower portion is likely to become lower than that in an upper portion of the refrigerant tubes.

Accordingly, when the condensed water remains in the air passages between the refrigerant tubes and the cooling-storage containers in the lower portion thereof, the condensed water will be easily frozen. Then, it may cause a disadvantage that the heat exchanger may be deformed due to cubical expansion generated by the freeze of the condensed water.

SUMMARY OF THE DISCLOSURE

The present invention is made in view of the above points. It is an object of the present disclosure to provide a cooling-storage type heat exchanger, in which it is possible to avoid such a situation that the heat exchanger may be deformed due to the freeze of condensed water.

According to a feature of the present disclosure (for example, as defined in claim 1 attached hereto), a cooling-storage type heat exchanger has:

a first and a second header tanks;

multiple refrigerant tubes extending in a vertical direction, each of which has a refrigerant passage, wherein the refrigerant tubes are arranged at distances in a tube-arrangement direction and between the first and second header tanks, so that refrigerant flows through the refrigerant passage at least from one of the first and second header tanks to the other header tank;

a cooling-storage container having a cooling-storage material therein and arranged between neighboring refrigerant tubes, wherein a side wall of the cooling-storage container is opposing to a side wall of the refrigerant tube in the tube-arrangement direction; and multiple convex portions outwardly projecting and multiple concave portions inwardly projecting, which are formed in the side wall of the refrigerant tube and/or the cooling-storage container and which are alternately arranged in the vertical direction.

In the heat exchanger, the refrigerant tubes are jointed to the cooling-storage container at such first portions at which the convex portions are formed, while the refrigerant tubes are separated from the cooling-storage container at such second portions at which the concave portions are formed, so that air passages are formed at the second portions through which outside air passes between the refrigerant tubes and the cooling-storage container, and a sectional area of the air passage, which is formed in a lower portion of the cooling-storage container below a predetermined height in the vertical direction and between the refrigerant tubes and the cooling-storage container, is made larger than that of the air passage, which is formed in an upper portion of the cooling-storage container above the predetermined height in the vertical direction and between the refrigerant tubes and the cooling-storage container.

According to the above feature, the multiple air passages are formed by the multiple concave portions between the refrigerant tubes and the cooling-storage containers. The sectional area of the air passages formed in the lower portion of the cooling-storage container below the predetermined height is made larger than that of the air passages formed in the upper portion of the cooling-storage container above the predetermined height.

When the condensed water is generated at the surfaces of the heat exchanger and flows in the gravity direction, the condensed water reaches at the lower portion of the cooling-storage container which is below the predetermined height. However, even in such a case, the condensed water may hardly fill the air passage below the predetermined height and remain there, because the sectional area of the air passage below the predetermined height is larger than that of the air passage above the predetermined height. As a result, it is possible to avoid a situation in which the cooling-storage type heat exchanger may be deformed, even when the condensed water is frozen.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
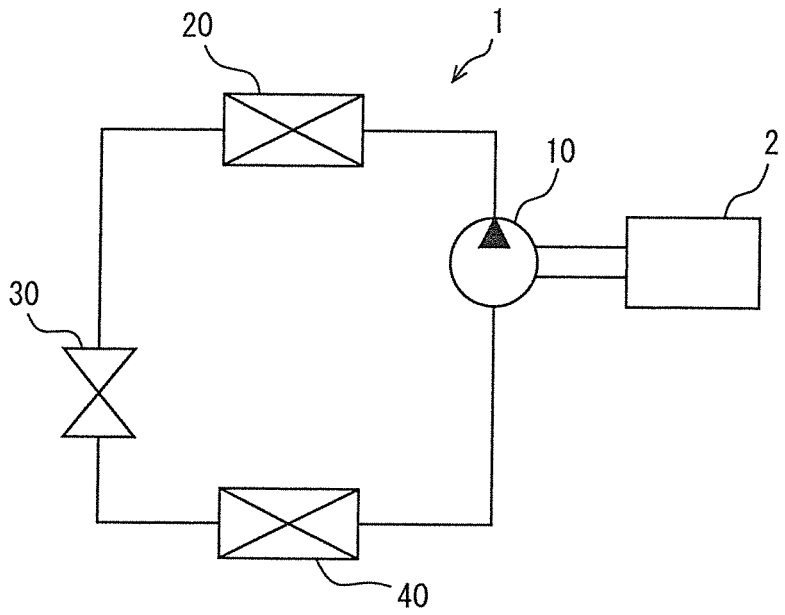
FIG. 1 is a schematic block diagram showing a refrigerating cycle according to a first embodiment of the present disclosure.

The present disclosure will be explained by way of multiple embodiments and modifications with reference to the drawings. The same reference numerals are used throughout the embodiments and modifications for the purpose of designating the same or similar parts and/or components.

(First Embodiment)

FIG. 1 is a block diagram showing a refrigerating cycle 1 for an air conditioning apparatus of a vehicle according to a first embodiment of the present disclosure. The refrigerating cycle 1 has a compressor 10, a heat radiating device 20, a depressurizing device 30, and a cooling-storage type heat exchanger (an evaporator) 40. Those components are connected by refrigerant pipes in a closed circuit, so that refrigerant is circulated in the closed circuit.

The compressor 10 is operated by a driving source 2, which is an internal combustion engine (or an electric motor or the like) for driving the vehicle. Therefore, when the driving source 2 is stopped, the operation of the compressor 10 is also stopped. The compressor 10 draws the refrigerant from the evaporator 40, compresses the same and discharges the compressed refrigerant to the heat radiating device 20. The heat radiating device 20 cools down the high temperature refrigerant. The heat radiating device 20 is also referred to as a condenser. The depressurizing device 30 depressurizes the refrigerant cooled down by the condenser 20. The evaporator 40 vaporizes the refrigerant depressurized by the depressurizing device 30 to cool down air passing through the evaporator 40, so that the cooled-down air is supplied into a passenger compartment of the vehicle.

Figure 2:
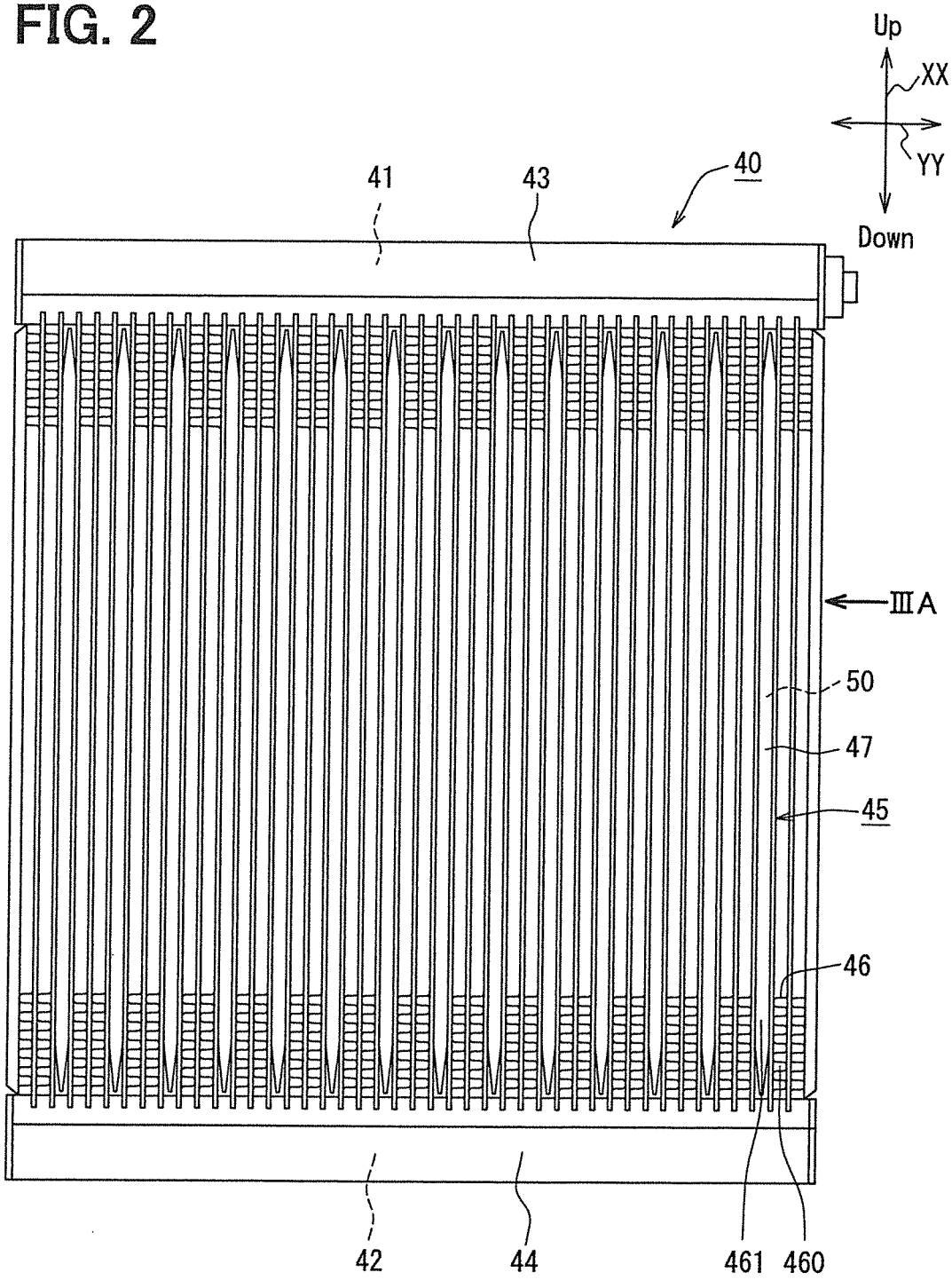
FIG. 2 is a schematic plan view showing a heat exchanger according to the first embodiment.
Figure 3A:
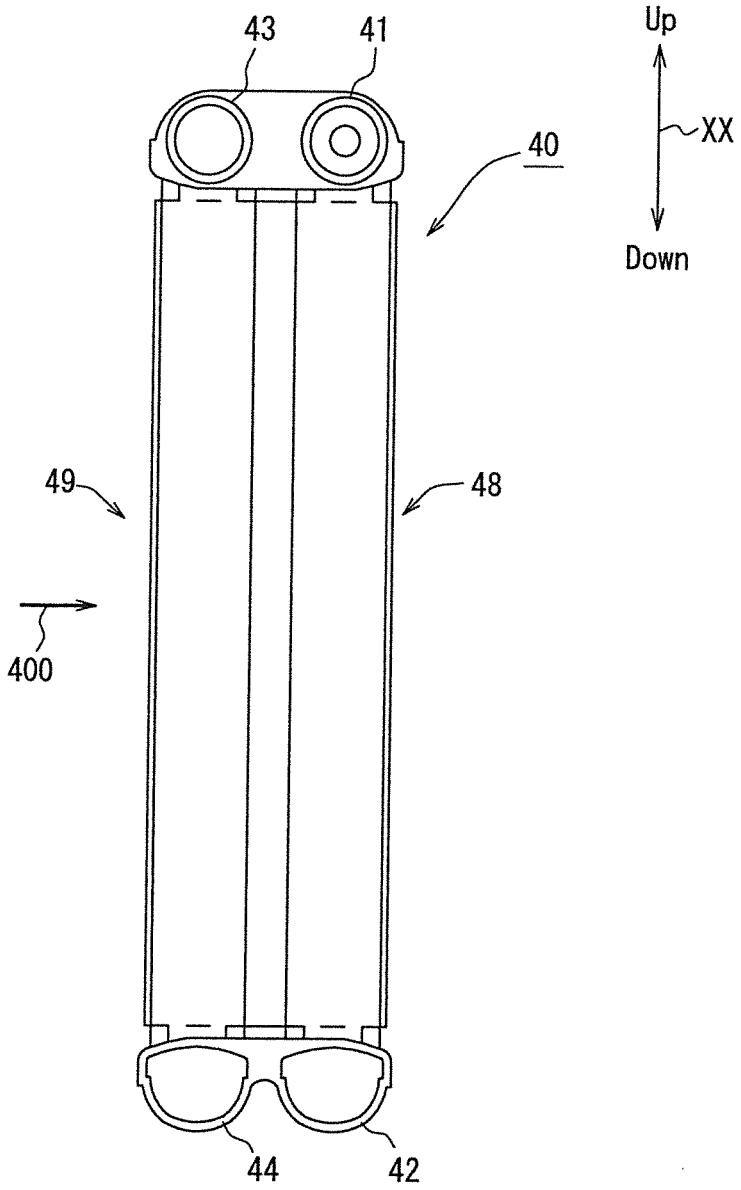
FIG. 3A is a schematic side view showing the heat exchanger according to the first embodiment, when viewed in a direction of an arrow IIIA in FIG. 2.
Figure 3B:
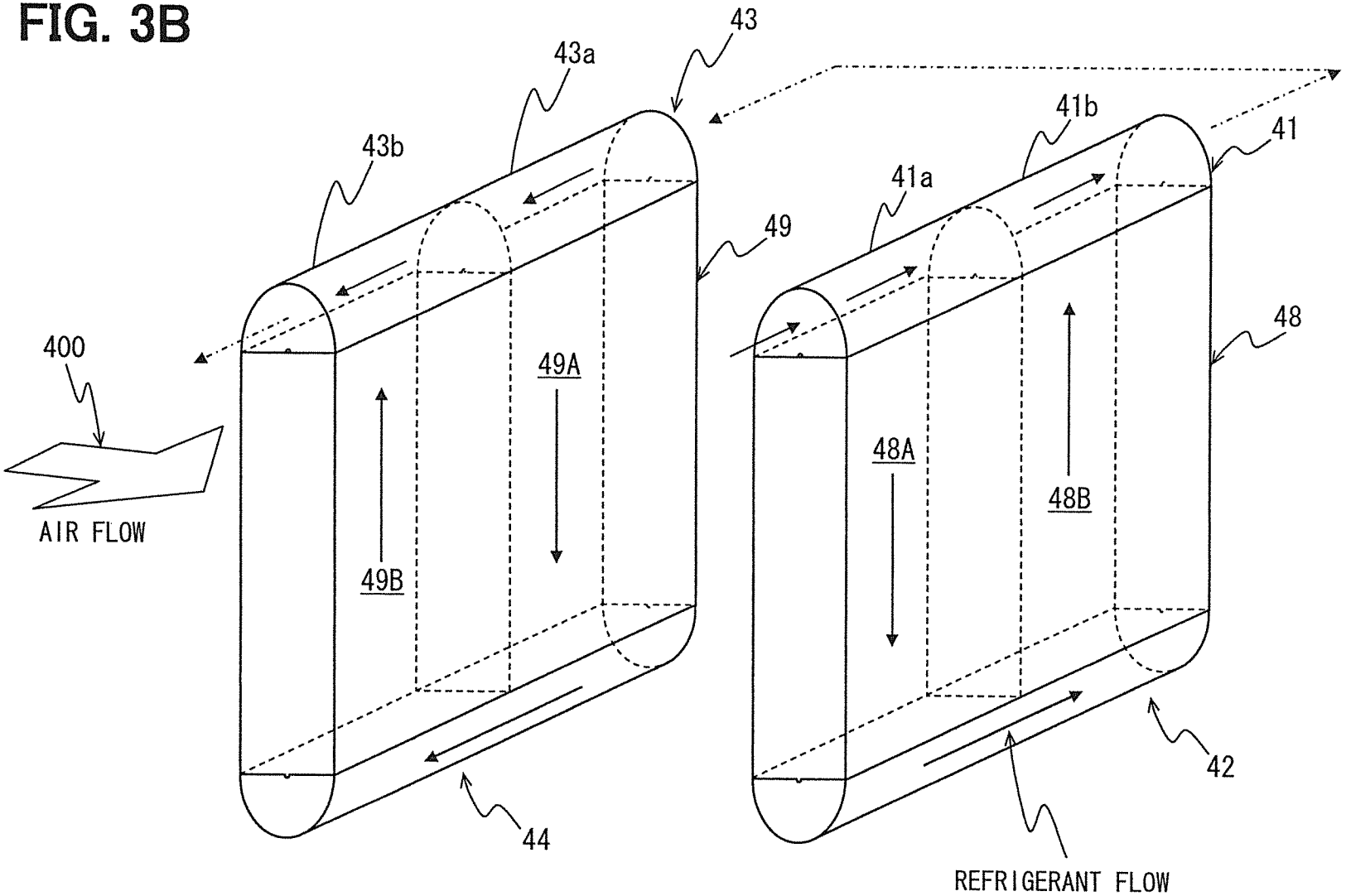
FIG. 3B is a schematic perspective view of the heat exchanger showing refrigerant flow in the heat exchanger.

FIG. 2 is a schematic plan view showing the evaporator 40 of the present embodiment. FIG. 3A is a schematic side view showing the evaporator 40, when viewed in a direction of an arrow IIIA in FIG. 2. FIG. 3B is a schematic perspective view of the evaporator 40 showing refrigerant flow in the evaporator 40.

In FIGS. 2, 3A and 3B, the evaporator 40 has multiple refrigerant flow paths, which are formed by passage members made of metal, such as aluminum. The refrigerant flow paths are formed by pairs of header tanks 41 & 42 and 43 & 44 and multiple refrigerant tubes 45 connecting header tanks of each pair. The refrigerant flows are indicated by arrows in FIG. 3B.

In FIGS. 2, 3A and 3B, a first and a second header tanks 41 and 42 form a first pair of tanks, wherein each of the header tanks 41 and 42 is arranged at a predetermined distance and in parallel to each other. In the same manner, a third and a fourth header tanks 43 and 44 form a second pair of tanks, wherein each of the header tanks 43 and 44 is arranged at a predetermined distance and in parallel to each other.

A plurality of refrigerant tubes 45, which extend in a vertical direction (in an XX direction in the drawing), are arranged in a tube-arrangement direction (in a YY direction in the drawing) between the first and second header tanks 41 and 42 at equal distances. Each upper and lower ends of the respective refrigerant tubes 45 are communicated with insides of the respective header tanks 41 and 42. A first heat exchanger portion 48 is formed by the first and second header tanks 41 and 42 and the multiple refrigerant tubes 45 arranged between them.

In the same manner, a plurality of refrigerant tubes 45, which extend in the vertical direction (the XX direction), are arranged in the tube-arrangement direction (the YY direction) between the third and fourth header tanks 43 and 44 at equal distances. Each upper and lower ends of the respective refrigerant tubes 45 are communicated with insides of the respective header tanks 43 and 44. A second heat exchanger portion 49 is formed by the third and fourth header tanks 43 and 44 and the multiple refrigerant tubes 45 arranged between them.

As above, the evaporator 40 (the heat exchanger) is composed of two-layered first and second heat exchanger portions 48 and 49, which are arranged at a predetermined distance in a direction of an air flow (indicated by an arrow 400 in FIGS. 3A and 3B). The second heat exchanger portion 49 is positioned at an upstream side of the air flow 400, while the first heat exchanger portion 48 is positioned at a downstream side thereof. The first heat exchanger portion 48 is also referred to as a first group of the refrigerant tubes, while the second heat exchanger portion 49 is also referred to as a second group of the refrigerant tubes which are arranged at the upstream side of the first group of the refrigerant tubes and arranged in parallel to one another.

A joint (not shown), which is formed as an inlet port for the refrigerant, is provided at one end of the first header tank 41. The inside of the first header tank 41 is divided into two (first and second) header portions 41*a* and 41*b* by a partition (not shown), which is provided at an intermediate portion of the first header tank 41 in its longitudinal direction. The multiple refrigerant tubes 45 of the first heat exchanger portion 48 are correspondingly divided into two (first and second) tube groups 48A and 48B.

The refrigerant flows into the first header portion 41*a* of the first header tank 41. Then, the refrigerant is distributed from the first header portion 41*a* to the multiple refrigerant tubes 45 of the first tube group 48A. The refrigerant flows through the refrigerant tubes 45 of the first tube group 48A and flows into the second header tank 42.

The refrigerant is collected in the second header tank 42 and distributed to the multiple refrigerant tubes 45 of the second tube group 4813. The refrigerant flows through the multiple refrigerant tubes 45 of the second tube group 4813 and flows into the second header portion 41*b* of the first header tank 41. As above, a U-shaped flow path for the refrigerant is formed in the first heat exchanger portion 48.

A joint (not shown), which is formed as an outlet port for the refrigerant, is provided at one end of the third header tank 43. The inside of the third header tank 43 is likewise divided into two (first and second) header portions 43*a* and 43*b* by another partition (not shown), which is provided at an intermediate portion of the third header tank 43 in its longitudinal direction.

The multiple refrigerant tubes 45 of the second heat exchanger portion 49 are also divided into two (first and second) tube groups 49A and 49B. The first header portion 43*a* of the third header tank 43 is provided adjacent to the second header portion 41*b* of the first header tank 41, so that the first header portion 43*a* of the third header tank 43 and the second header portion 41*b* of the first header tank 41 are communicated with each other, as indicated by a dotted line in FIG. 3B.

The refrigerant flows from the second header portion 41*b* of the first header tank 41 into the first header portion 43*a* of the third header tank 43. Then, the refrigerant is distributed from the first header portion 43*a* to the multiple refrigerant tubes 45 of the first tube group 49A. The refrigerant flows through the refrigerant tubes 45 of the first tube group 49A and flows into the fourth header tank 44. The refrigerant is collected in the fourth header tank 44 and distributed to the multiple refrigerant tubes 45 of the second tube group 49B.

The refrigerant flows through the multiple refrigerant tubes 45 of the second tube group 49B and flows into the second header portion 43*b* of the third header tank 43. As above, a U-shaped flow path for the refrigerant is also formed in the second heat exchanger portion 49. The refrigerant, which flows out through an outlet port (not shown) from the second header portion 43*b* of the third header tank 43, flows toward the compressor 10.

As shown in FIG. 2, the multiple refrigerant tubes 45 are arranged in the YY direction at almost constant distances. Multiple spaces (that is, accommodating spaces) are respectively formed between the neighboring refrigerant tubes 45. Multiple outer fins 46 (air-side fins) and multiple cooling-storage containers 47 are respectively disposed in the respective accommodating spaces in accordance with a predetermined ordinality and soldered to the refrigerant tubes. Some of the accommodating spaces, in which the outer fins 46 are disposed, correspond to air passages 460 for cooling air. The remaining accommodating spaces, in which the cooling-storage containers 47 having cooling-storage material 50 therein are disposed, correspond to a container accommodating portion 461.

For example, paraffin or the like may be used as the cooling-storage material 50. A small amount of air is filled in the cooling-storage container 47 at an upper side of the cooling-storage material 50. A stress, which may be generated in the cooling-storage container 47 when the cooling-storage material 50 is expanded, is absorbed by compression action of the air.

Spaces, which correspond to an amount between 10% and 50% of all accommodating spaces formed between the respective refrigerant tubes 45, are used as the container accommodating portions 461, that is the spaces for the cooling-storage containers 47. The cooling-storage containers 47 are equally arranged over the evaporator 40 in the longitudinal direction of the header tanks 41 to 44 (the YY direction). Each of the refrigerant tubes 45 disposed at both sides of the cooling-storage container 47 respectively defines the air passage 460 together with each of the opposing refrigerant tubes 45, through which the cooling air passes for carrying out heat exchange with the refrigerant flowing through the insides of the refrigerant tubes 45.

In other words, one refrigerant tube 45 is arranged between two neighboring outer fins (the air-side fins) 46, and one cooling-storage container 47 is arranged between the two neighboring refrigerant tubes 45.

As shown in FIGS. 9 to 13, each of the refrigerant tubes 45 is formed of a multi-passage pipe having multiple refrigerant flow passages 45*c*. The refrigerant tube 45 is also referred to as a flat tube 45. The multi-passage pipe may be formed by an extrusion process. The multiple refrigerant flow passages 45*c* extend in a longitudinal direction of the refrigerant tube 45 (in the vertical direction; the XX direction) and opened at both ends of the refrigerant tube 45.

A plurality of the refrigerant tubes 45 is arranged in a line, which extends in parallel to the longitudinal direction of the header tanks (in the horizontal direction; the YY direction). In each of the lines for the refrigerant tubes 45, side walls (side walls in the YY direction) of the respective refrigerant tubes 45 are opposing to each other. The refrigerant tubes 45 form the air passages 460 (for the heat exchange between the refrigerant and the air) and the container accommodating portions 461 (for accommodating the cooling-storage containers 47) between the respective neighboring refrigerant tubes 45.

The evaporator 40 has multiple outer fins (the air-side fins) 46 arranged in the air passages 460 for increasing contact area with the air to be supplied into the passenger compartment of the vehicle. The air-side fin 46 is composed of a corrugate-type fin 46.

Each of the fins 46 is arranged in the respective air passages 460 formed between the neighboring refrigerant tubes 45. The fin 46 is thermally connected with the refrigerant tubes 45. The fin 46 is attached to the refrigerant tubes 45 by jointing material having a high heat transfer. The jointing material is, for example, soldering material. The fin 46 is made of a thin metal plate, such as aluminum, and formed in a wave shape.

The evaporator 40 further has a plurality of cooling-storage containers 47, each of which is made of a metal, such as aluminum.

In FIGS. 6 to 13, the refrigerant tubes 45 are also shown for the purpose of explaining in an easily understood manner a joint construction between the cooling-storage container 47 and the refrigerant tubes 45. However, the cooling-storage material 50, which is filled in the inside of the cooling-storage container 47, is omitted in those drawings for the purpose of showing the structure of the cooling-storage container 47 in an easily understood manner.

Figure 6:
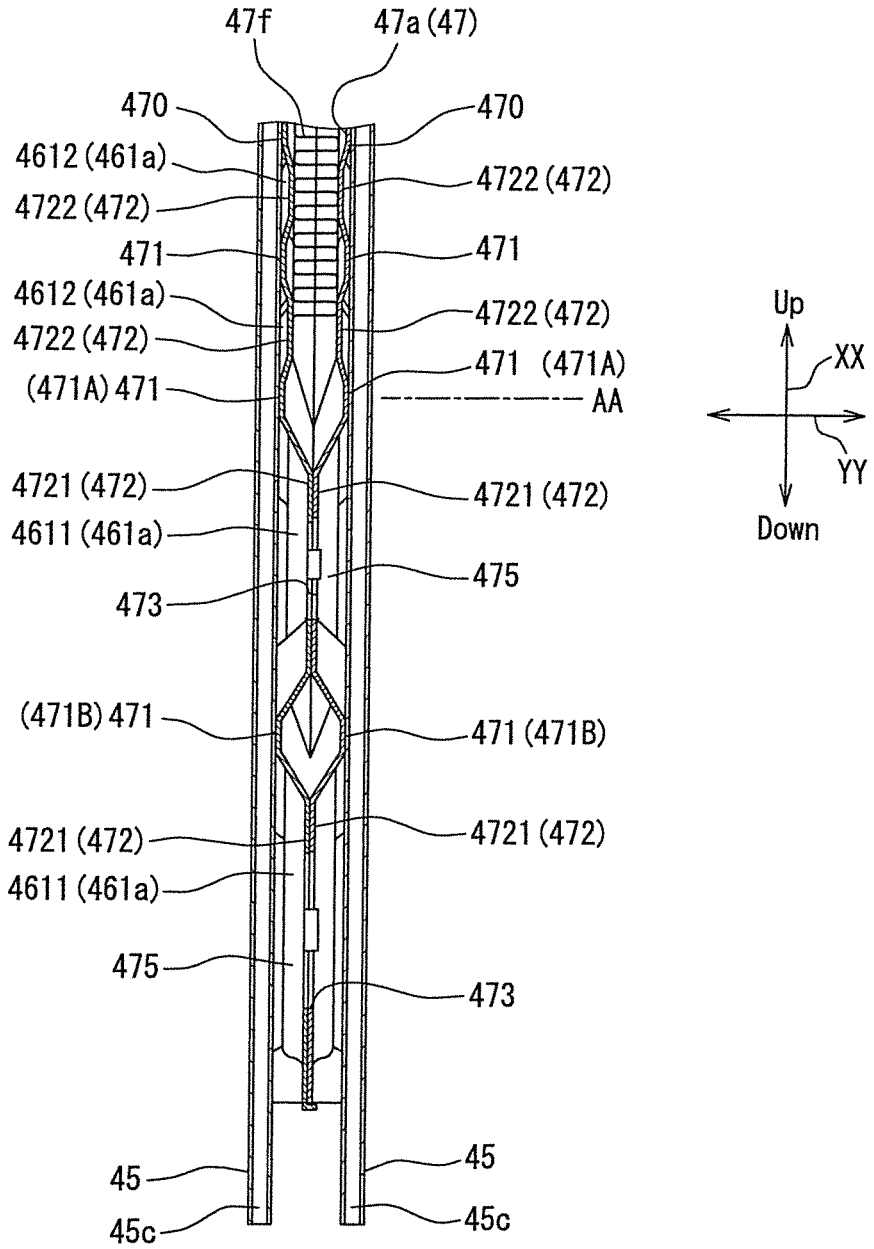
FIG. 6 is a schematic cross sectional view taken along a line VI-VI in FIG. 4.
Figure 7:
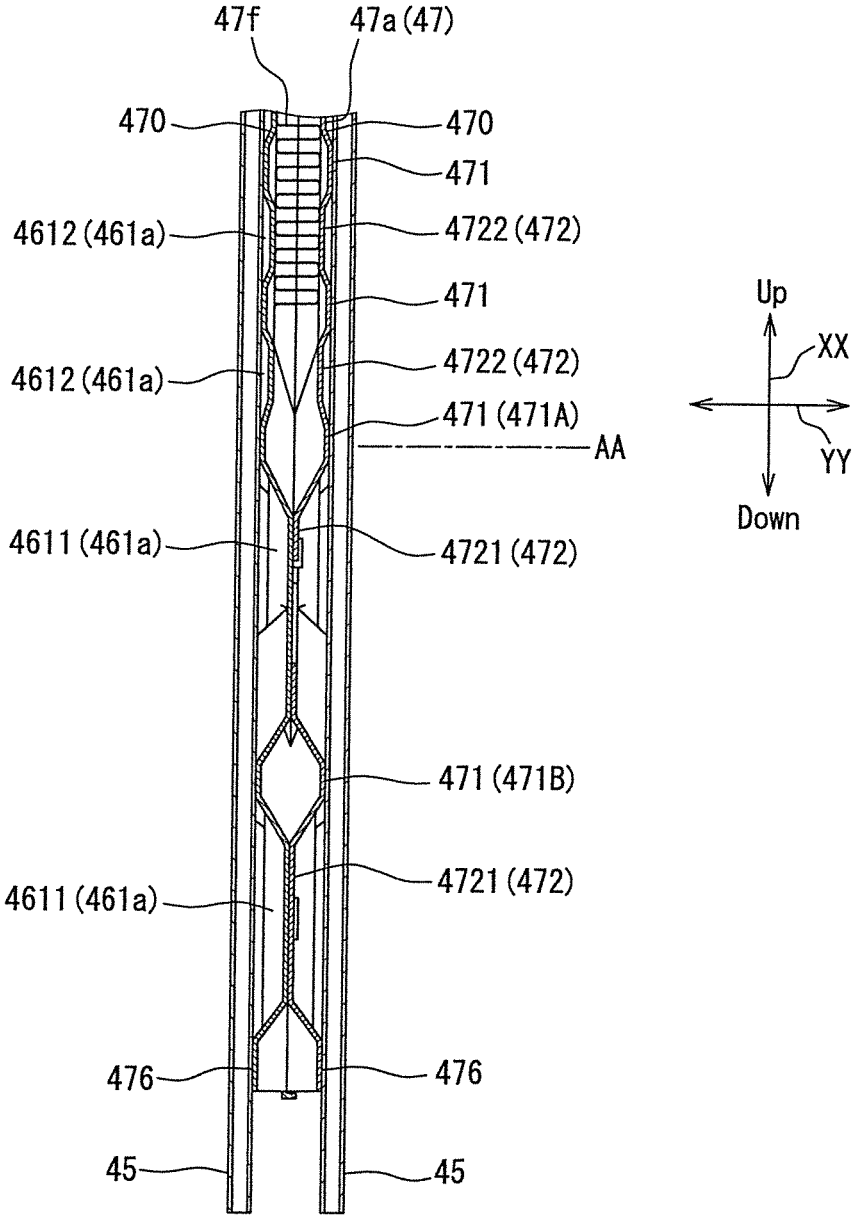
FIG. 7 is a schematic cross sectional view taken along a line VII-VII in FIG. 4.
Figure 8:
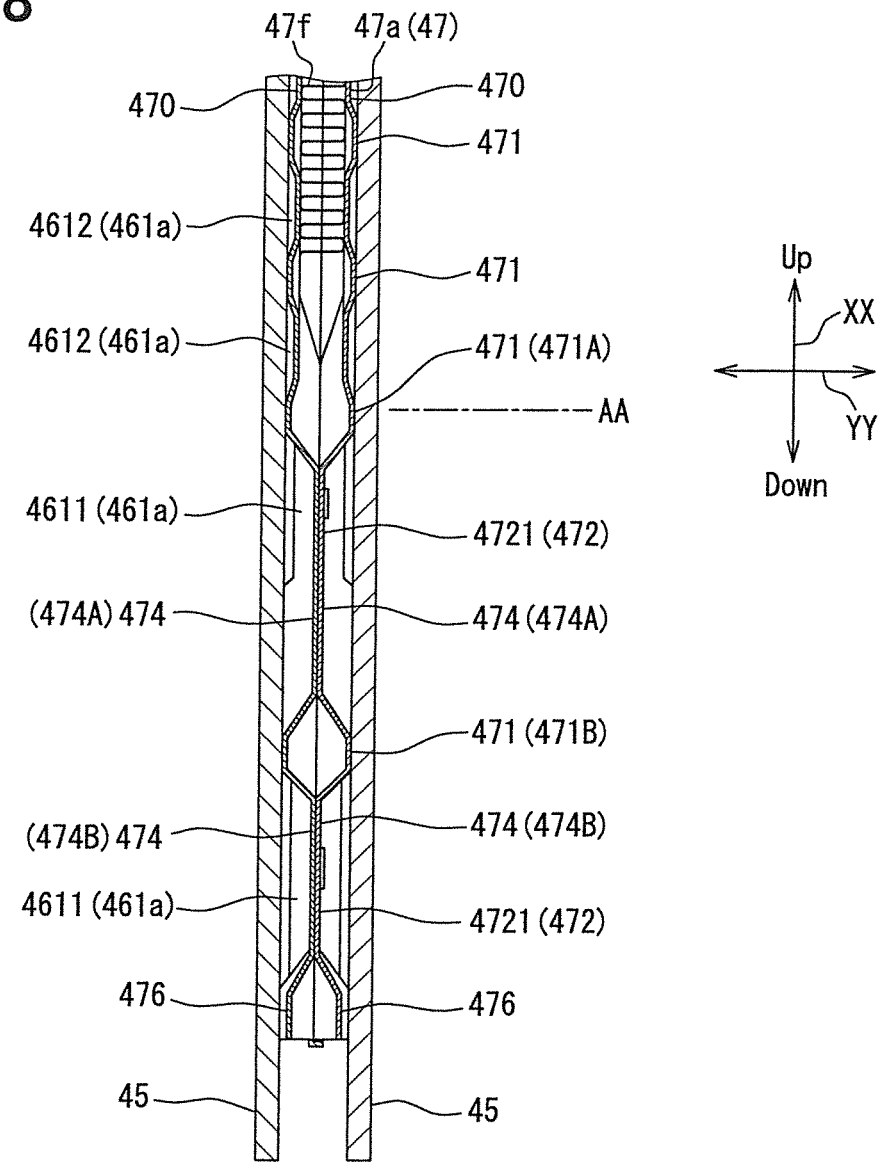
FIG. 8 is a schematic cross sectional view taken along a line VIII-VIII in FIG. 4.
Figure 9:
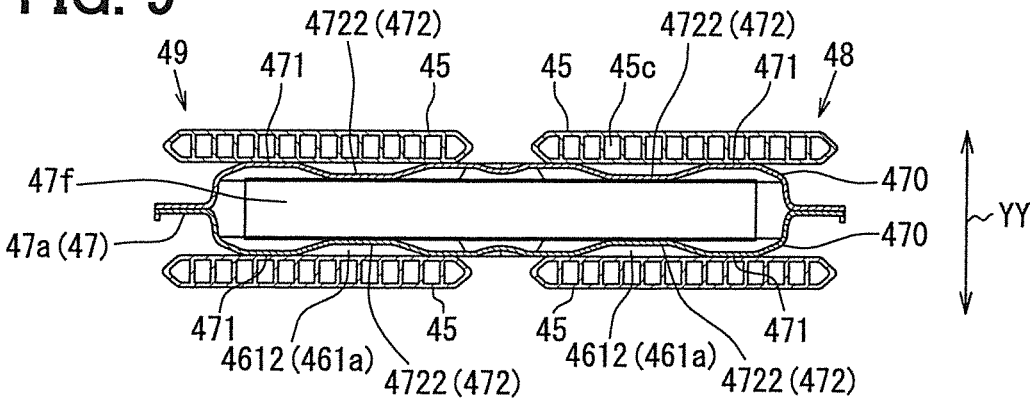
FIG. 9 is a schematic cross sectional view taken along a line IX-IX in FIG. 4.

Each of the cooling-storage containers 47 (shown in FIGS. 4 and 5) is composed of a pair of plate members, which are press worked and which are so overlapped in the YY direction that each rear surface of the plate member is opposing to the other rear surface. Each of the plate members has an outer envelope portion 47*a*, which is soldered to the outer envelope portion 47*a* of the other plate member at an outer periphery. The outer envelope portion 47*a* is formed in a flat tube shape having a concavo-convex shape in its side wall 470 in the YY direction. Both longitudinal ends of the cooling-storage container 47 (in the vertical direction; the XX direction) are closed to define a closed space therein for accommodating the cooling-storage material 50. As shown in FIGS. 6 to 8, an inner fin 47*f* is arranged in the inside of the outer envelope portions 47*a*.

Figure 4:
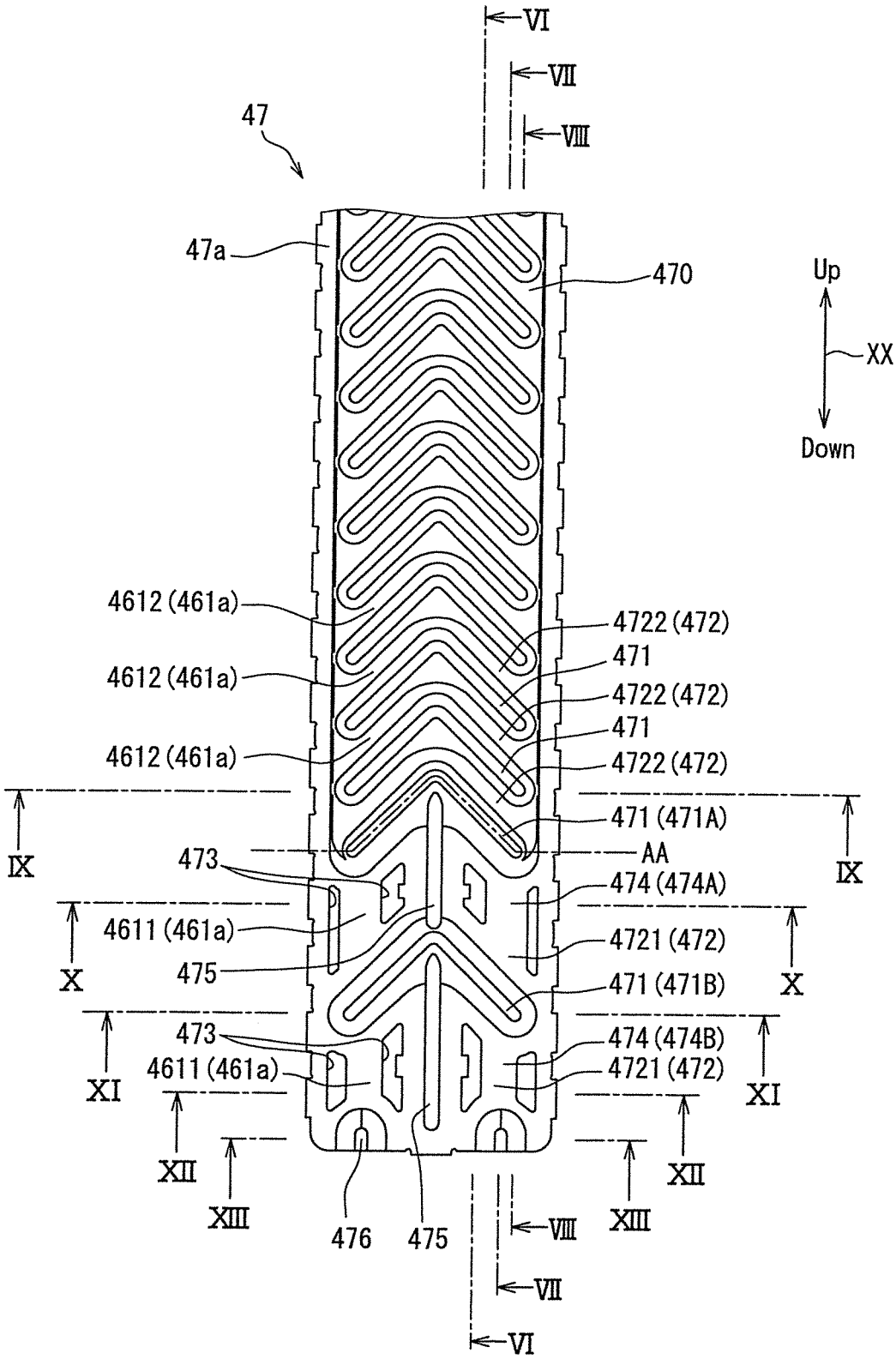
FIG. 4 is a schematically enlarged front view showing a relevant portion of a cooling-storage container 47.
Figure 5:
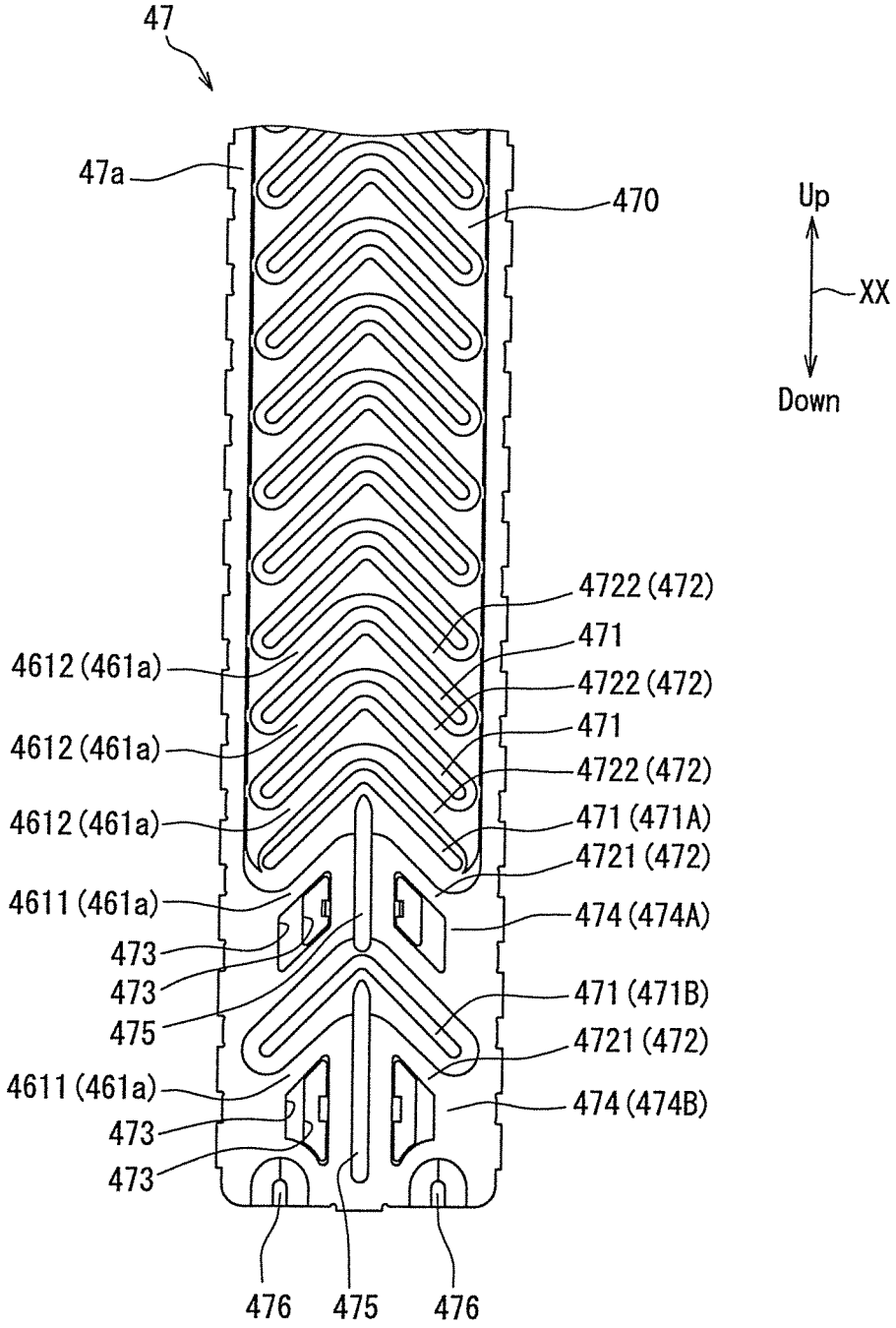
FIG. 5 is a schematically enlarged rear view showing the relevant portion of the cooling-storage container 47.

As shown in FIGS. 4 and 5, multiple convex portions 471 (outwardly projecting) and multiple concave portions 472 (inwardly projecting) are formed on an outer surface of the side wall 470 of each outer envelope portion 47*a*. The multiple convex portions 471 and multiple concave portions 472 are alternately formed in the side wall 470 in the vertical direction (in the XX direction). The convex portion 471 is formed in a reversed V-shape. The concave portion 472 formed between the convex portions 471 (neighboring to them in the vertical direction; the XX direction) is likewise formed in the reversed V-shape.

As shown in FIGS. 6 to 8, the cooling-storage container 47 is connected to the refrigerant tubes 45 at such portions, at which the convex portions 471 are formed. Namely, each outwardly projected end of the convex portion 471 is fixed to the refrigerant tube 45. The refrigerant tubes 45 and the cooling-storage containers 47 are fixed to each other by the jointing material having the high heat transfer. The soldering material, the resin material (such as, adhesive material) or the like can be used as the jointing material. In the present embodiment, the cooling-storage containers 47 are fixed to the refrigerant tubes 45 by the soldering material.

The cooling-storage container 47 is separated from the refrigerant tubes 45 at such portions, at which the concave portions 472 are formed. Such spaces between the cooling-storage container 47 and the refrigerant tube 45 form air passages 461*a* (also referred to as a cooling-storage side air passage), through which a part of outside air (air-conditioning fluid for the passenger compartment) passes. Since the air passages 461*a* (of the cooling-storage side) are formed between the concave portions 472 (which are formed between the convex portions 471) and flat plate portions (flat wall portions) of the refrigerant tubes 45, the air passages 461*a* are also formed (curved) in the reversed V-shape in a direction in which the outside air (the air-conditioning fluid) passing through the evaporator 40, as shown in FIGS. 4 and 5.

As shown in FIGS. 4 and 5, the multiple air passages 461*a* formed by the respective concave portions 472 in a lower portion of the cooling-storage container 47 (more exactly, in the lower portion below a predetermined height indicated by a line AA shown in FIG. 4) are designated by a reference numeral 4611, while the other air passages 461*a* formed in an upper portion of the cooling-storage container 47 above the line AA (the predetermined height) are designated by a reference numeral 4612. In the present embodiment, a sectional area of the air passages 4611 (also referred to as a lower-side air passage) is made larger than that of the air passages 4612 (also referred to as an upper-side air passage).

The convex portion 471, which is located at a lower-most position in the upper portion of the cooling-storage container 47 above the line AA, is also referred to as a lower-most convex portion 471A. The convex portion 471, which is located in the lower portion of the cooling-storage container 47 below the line AA, is also referred to as a lower-side convex portion 471B.

As shown in FIGS. 6 to 8, the multiple concave portions 472 formed in the lower portion of the cooling-storage container 47 below the line AA are designated by a reference numeral 4721, while the other concave portions 472 above the line AA are designated by a reference numeral 4722. A width dimension of the concave portions 4721 (also referred to as a lower-side concave portion) in the vertical direction (the XX direction) is made larger than that of the concave portions 4722 (also referred to as an upper-side concave portion). In addition, a depth dimension of the lower-side concave portions 4721 (in the YY direction) is made larger than that of the upper-side concave portions 4722.

Namely, the width dimension as well as the depth dimension of the lower-side concave portions 4721 (below the line AA, that is, the predetermined height) is made larger than that of the upper-side concave portions 4722 (above the line AA). In other words, the sectional area of the lower-side air passages 4611 (below the line AA) is made larger than that of the upper-side air passages 4612 (above the line AA).

As shown in FIGS. 6 to 8, in the lower portion of the cooling-storage container 47, that is, in the area below the line AA, bottom portions of the lower-side concave portions 4721 (which are formed in side walls 470 of the outer envelope portions 47*a* and opposing to each other in the YY direction) are directly in contact with and fixed to each other. On the other hand, in the upper portion of the cooling-storage container 47, that is, in the area above the line AA, bottom portions of the upper-side concave portions 4722 (which are opposing to each other in the YY direction) are fixed to each other via the inner fin 47*f*.

As above, the inner fin 47*f* is arranged in the inside of the outer envelope portions 47*a* of the cooling-storage container 47 in the area above the line AA, wherein the inner fin 47*f* is mechanically and thermally connected to the cooling-storage container 47. In the area below the line AA, the inner fin 47*f* is not arranged and the lower-side concave portions 4721 of the outer envelope portions 47*a* are directly connected to each other.

The joint between the inner fin 47*f* and the upper-side concave portions 4722 as well as the joint of the lower-side concave portions 4721 to each other is done by the jointing material having the high heat transfer. For example, the joint is done by the soldering. In the upper area above the line AA, since the inner fin 47*f* is fixed to the inner surfaces of the outer envelope portions 47*a* of the cooling-storage container 47, a deformation of the cooling-storage container 47 can be suppressed and thereby pressure resistance can be improved. In the lower area below the line AA since the outer envelope portions 47*a* of the cooling-storage container 47 are directly fixed to each other, a deformation of the cooling-storage container 47 can be likewise suppressed and thereby pressure resistance can be improved.

In addition, since the inner fin 47*f* is fixed to the inner surfaces of the outer envelope portions 47*a* of the cooling-storage container 47, heat transfer (of cold energy) in a cold-energy storing process from the refrigerant to the cooling-storage material 50 as well as heat transfer in a cold-energy discharging process from the cooling-storage material 50 to the air can be effectively done.

As shown in FIGS. 6 to 8, the inner fin 47*f* is made of a thin metal plate (such as, aluminum) and formed in a wave shape. Since the inner surface of the cooling-storage container 47 is formed in the concavo-convex shape, the inner fin 47*f* is connected to the concave portions 4722 of the outer envelope portions 47*a* (of the cooling-storage container 47), more exactly, soldered to the inwardly projected portions of the concave portions 4722 so that mechanical strength as well as the pressure resistance is increased. As shown in the drawings, the inner fin 47*f* is not fixed to the outwardly projected portions of the convex portions 471.

Although not shown in the drawings, multiple louvers (press-cut and bent portions) may be formed in the inner fin 47*f* by press work.

As shown in FIGS. 4 to 6, 10 and 12, multiple opening portions 473 are formed in the both side walls 470 of the cooling-storage container 47, more exactly, formed in the bottom portions of the concave portions 4721 (opposing to and fixed to each other in the YY direction) in the lower portion of the cooling-storage container 47 below the line AA.

The opening portions 473 are formed for the purpose of reducing a direct contacting area between the bottom portions of the respective concave portions 4721. As a result of forming the opening portions 473, a distance between each and every point in the direct contacting area and a peripheral end of the direct contacting area becomes shorter. Even when any gas is generated in the direct contacting area during a manufacturing process (in a joint step), such gas is easily discharged from the direct contacting area to the outside. A joint deficiency, such as, voids in the direct contacting area, is hardly generated, to thereby increase joint quality and joint strength.

In the present embodiment, a width of the direct contacting area of the concave portions 4721 between the opening portions 473 is made to be, for example, 3 mm, so that the distance between each point in the direct contacting area and the peripheral end of the direct contacting area does not exceed 1.5 mm.

As shown in FIGS. 4, 5 and 8, each of the side walls 470 of the cooling-storage container 47 has first and second wall portions 474A and 474B, each of which continuously extends in a downward direction from a lower side of the respective convex portions 471 (that is, from a lower side of the lower-most convex portion 471A of the reversed V-shape and from a lower side of the lower-side convex portion 471B of the reversed V-shape). The first and second wall portions 474A and 474B are formed in the lower portion of the cooling-storage container 47 below the line AA and collectively referred to as water-guide walls 474.

More in detail, in the upper portion of the cooling-storage container 47 above the line AA, the bottom portion of the concave portion 4722 continuously extends in the downward direction from the lower side of each convex portion 471. In the lower portion of the cooling-storage container 47 below the line AA, the bottom portion of one of the concave portions 4721 (the first wall portion 474A) continuously extends in the downward direction from the lower side of the lower-most convex portion 471A. The bottom portion of the other concave portion 4721 (the second wall portion 474B) continuously extends in the downward direction from the lower side of the lower-side convex portion 471B. The opening portions 473 are not formed in the water-guide walls 474.

In the cold-energy storing operation for the cooling-storage material 50, condensed water is generated at the outer surfaces of the refrigerant tubes 45 as well as the outer surfaces of the cooling-storage container 47 (more exactly, at the outer surfaces of the concave portions 472 (4721 and 4722), in which the air passages 461*a* (4611 and 4612) are formed). The condensed water flows in the downward direction along the respective concave portions 4722 and reaches at lower-most portions of the air passages 4612 (that is, a left-hand and a right-hand side lower-most portion of the air passage 4612 in FIGS. 4 and 5). Then, the condensed water comes around to the lower-most portion of the lower-most convex portion 471A below the air passage 4612. Since the water-guide walls 474 extend in the downward direction from the lower sides of the respective convex portions 471 (471A and 471B), the condensed water is guided along the water-guide walls 474 toward a lower end of the cooling-storage container 47.

The condensed water guided to the lower ends of the respective cooling-storage containers 47 falls in drops on the header tanks 42 and 44 shown in FIGS. 2, 3A and 313. The condensed water flows down along outer surfaces of the header tanks 42 and 44 and finally discharged from the evaporator 40 in the downward direction. Accordingly, it is possible to prevent the condensed water from remaining in the air passages 461*a* of the cooling-storageside.

As shown in FIGS. 9 to 13, each of the refrigerant tubes 45 of the first heat exchanger portion 48 and each of the refrigerant tubes 45 of the second heat exchanger portion 49 are aligned with each other in the flow direction 400 of the outside air. An upstream side of each cooling-storage container 47 is arranged between the refrigerant tubes 45 of the second heat exchanger portion 49, while a downstream side thereof is arranged between the refrigerant tubes of the first heat exchanger portion 48.

As shown in FIGS. 4 to 6 and 10 to 12, multiple center projections 475 are formed in the concave portions 4721 (in the lower portion of the cooling-storage container 47 below the line AA), wherein each center projection 475 is formed in a center in a direction of the air flow 400 (in the horizontal direction in FIG. 4 or 5) and extends in the vertical direction (in the XX direction). The center projections 475 are formed in each of the outer envelope portions 47*a* (the pair of the metal plates) of the cooling-storage container 47 to form closed spaces, in which the cooling-storage material 50 are respectively filled.

Figure 10:
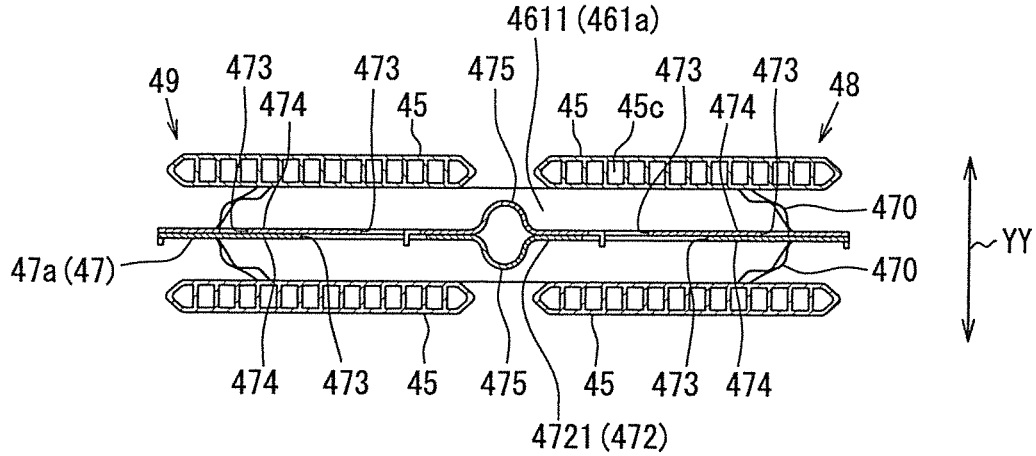
FIG. 10 is a schematic cross sectional view taken along a line X-X in FIG. 4.
Figure 11:
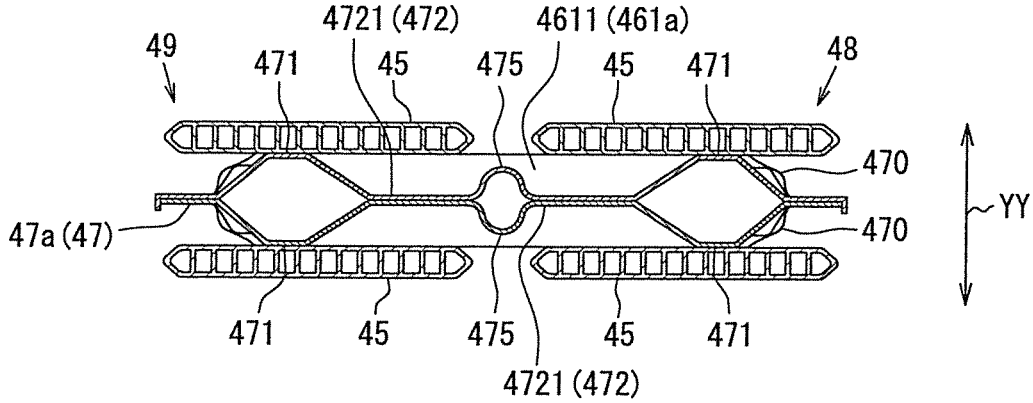
FIG. 11 is a schematic cross sectional view taken along a line XI-XI in FIG. 4.
Figure 12:
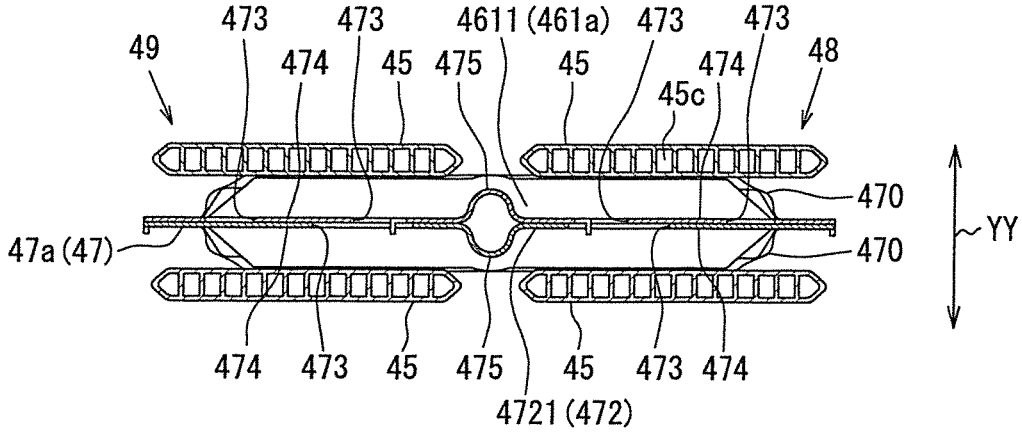
FIG. 12 is a schematic cross sectional view taken along a line XII-XII in FIG. 4.
Figure 13:
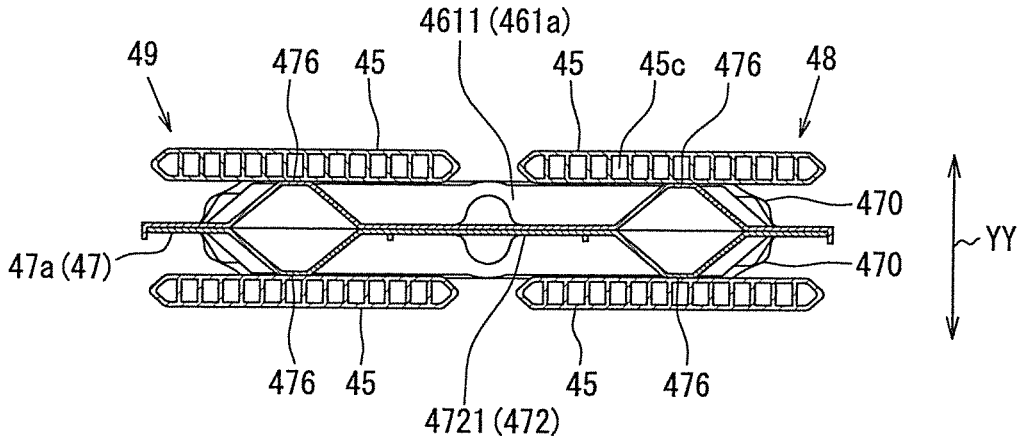
FIG. 13 is a schematic cross sectional view taken along a line XIII-XIII in FIG. 4.

As shown in FIGS. 10 to 12, each of the center projections 475 is projected toward a space formed between the refrigerant tube 45 for the first heat exchanger portion 48 and the refrigerant tube 45 for the second heat exchanger portion 49.

As already explained above, in the evaporator 40 of the present embodiment, the sectional area of the lower-side air passages 4611 (below the line AA) is made larger than that of the upper-side air passages 4612 (above the line AA). If the center projections 475 were not formed, an air resistance in a lower part of the container accommodating portion 461 formed between the refrigerant tubes 45 (arranged in the YY direction) may become larger than that in a middle part of the container accommodating portion 461 (in which the convex portions 471 are formed in the high density). Then, the air flow may be biased to the lower portion of the cooling-storage container 47.

However, the bias of the air flow can be prevented by forming the center projections 475. Since each of the center projections 475 is projected toward the space formed between the refrigerant tube 45 for the first heat exchanger portion 48 and the refrigerant tube 45 for the second heat exchanger portion 49, the sectional area of the air passages 4611 (formed between the refrigerant tubes 45 for the first heat exchanger portion 48 and the cooling-storage container 47 and between the refrigerant tubes 45 for the second heat exchanger portion 49 and the cooling-storage container 47) is not reduced. The center projections 475 correspond to air-flow suppressing projections for suppressing air flow in the air passages 4611.

An inside space of the center projection 475 is communicated to an inside space of the lower-most convex portion 471A above the line AA and to an inside space of the lower-side convex portion 471B below the line AA. It is, therefore, easy to fill the cooling-storage material 50 into the lower-side convex portion 471B below the line AA. In addition, since the inside space of the center projection 475 can be used as the space for the cooling-storage material 50, the cold-energy storing performance can be increased.

As shown in FIGS. 4, 5, 7 and 13, multiple lower-end projections 476 are formed in the concave portion 4721 (which is below the lower-side convex portion 471B), more exactly, at a lower-most end of the concave portion 4721. Each of the lower-end projections 476 is projected in the YY direction. The multiple lower-end projections 476 are formed in each of the plate members forming the outer envelope portions 47*a* of the cooling-storage container 47. Each of the lower-end projections 476 is formed in a shape of a frustum of a half cone. Each of the lower-end projections 476 is outwardly projected and its forward end is brought into contact with and soldered to the corresponding refrigerant tube 45.

In the evaporator 40 of the present embodiment, each and every parts and components are temporarily assembled and then integrally and firmly soldered to one another. In the above temporal assembling step, a core portion is temporarily assembled, wherein the core portion is composed of the refrigerant tubes 45, the air-side fins 46, the cooling-storage containers 47 (the inner fin 47*f* is accommodated therein), and a pair of side plates (each of which is arranged at an outermost position in the YY direction as a reinforcing member). Those components for the core portion are built up in such an order shown in FIG. 2. Such a temporarily assembled core portion is then assembled to the header tanks 41 to 44, to thereby form a temporarily assembled evaporator 40.

When the temporarily assembled core portion is assembled to the header tanks 41 to 44, the core portion is inwardly pressed from both ends thereof in the YY direction in order that the air-side fins 46 as well as the other components are slightly and elastically deformed, to thereby bring them (the respective components of the temporarily assembled core portion) into a tight and firm contact with one another. In such a pressed condition, both upper and lower ends of the refrigerant tubes 45 of the temporarily assembled core portion are inserted into tube holes, which are formed in the header tanks 41 to 44 and which have almost the same pitch to that of the refrigerant tubes 45. As above, the temporarily assembled evaporator 40 is completed.

As shown in FIGS. 4, 5 and 8, a number of supporting points, at which the refrigerant tubes 45 are in contact with the convex portions 471 of the cooling-storage containers 47, in the lower portion of the cooling-storage container 47 below the line AA is smaller than that of the supporting points in the upper portion of the cooling-storage container 47 above the line AA. In a lower-most portion of the cooling-storage container 47 below the lower-side convex portion 471B, there is no supporting point for the refrigerant tubes 45 to be supported by the convex portion 471.

Therefore, if the lower-end projections 476 were not formed, the lower ends of the refrigerant tubes 45 of the temporarily assembled core portion (the cooling-storage container 47 is interposed between the refrigerant tubes 45) are likely to be bent to each other, when the temporarily assembled core portion is inwardly pressed from its both sides in the YY direction. When the lower ends of the refrigerant tubes 45 are bent to each other, the tube pitch at the lower ends of the refrigerant tubes may become unequal. It may become difficult to insert the lower ends of the refrigerant tubes 45 into the tube holes, which are formed in the header tanks 41 to 44 and which have almost the same pitch to that of the refrigerant tubes 45.

When the lower-end projections 476 are formed in the lower-most portion of the cooling-storage container 47 and the outwardly projected forward ends are brought into contact with the refrigerant tubes 45, as explained above, it is possible to prevent the lower ends of the refrigerant tubes 45 from being bent to the other refrigerant tube 45. The lower-end projections 476 correspond to tube-bent suppressing projections for suppressing bending of the refrigerant tubes 45 toward the cooling-storage container 47.

In the above evaporator 40, the air passages 461*a* are formed at the concave portions 472 of the cooling-storage container 47 between the refrigerant tubes 45 and the concave portions 472. The sectional area of each lower-side air passage 4611 (below the line AA) is made larger than that of each upper-side air passage 4612 (above the line AA).

In the cold-energy operation, in which the refrigerant flowing through refrigerant passages 45*c* of the refrigerant tubes 45 is vaporized to thereby cool down the air and to store the cold energy in the cooling-storage material 50, the condensed water is generated in the air passages 461*a* of the cooling-storage side. The condensed water flows down in the direction of gravity and reaches at portions of the outer surfaces of the cooling-storage containers 47 below the line AA. However, since the sectional area of the lower-side air passage 4611 below the line AA is relatively large, the condensed water hardly remains in the air passage 4611 to thereby fill the air passage 4611 with the condensed water by its surface tension. As a result, even when the condensed water (which remains in the air passage 4611) is frozen, it is possible to prevent the refrigerant tubes 45 and/or any other portions of the evaporator 40 from being deformed.

Some of the concave portions 472, that is, the concave portions 4721 which are formed in the lower portion of the cooling-storage container 47 below the line AA, have larger width dimension (in the XX direction) and larger depth dimension (in the YY direction) than those of the concave portions 4722 formed in the upper portion of the cooling-storage container 47 above the line AA. Therefore, the sectional area of each lower-side air passage 4611 (below the line AA) is made larger than that of each upper-side air passage 4612 (above the line AA).

In particular, the depth dimension (in the YY direction) of the lower-side concave portions 4721 below the line AA is made larger than that of the upper-side concave portions 4722 above the line AA.

According to the above structure, a distance between the refrigerant tube 45 and the cooling-storage container 47 in the lower-side air passage 4611 below the line AA is made larger than that between the refrigerant tube 45 and the cooling-storage container 47 in the upper-side air passage 4612 above the line AA. Therefore, when compared with a case, in which the refrigerant tube 45 and the cooling-storage container 47 are arranged closer to each other, it is much easier in the present embodiment to suppress an occurrence of such a situation that the condensed water remains in the lower-side air passage 4611 due to the surface tension. Accordingly, even when the condensed water (which remains in the air passage 4611) is frozen, it is possible to surely prevent the refrigerant tubes 45 and/or any other portions of the evaporator 40 from being deformed.

Since the convex portions 471 and the concave portions 472 of the cooling-storage container 47 are formed in the reversed V-shape, the condensed water can be easily discharged from the air passages 461*a* formed by the concave portions 472.

In addition, the cooling-storage container 47 has multiple water-guide walls 474, each of which continuously extends in the downward direction from the lower side of the respective convex portions 471A and 471B. Therefore, the condensed water generated in the air passages 461*a* can be guided in the downward direction along the water-guide walls 474. It is, therefore, possible to prevent the condensed water from remaining in the air passages 461*a*.

The sectional area of the lower-side air passage 4611 below the line AA is made to be relatively large. Therefore, even in a case that the condensed water remained in the air passages 4611 so as to fill them, and heat was absorbed from the condensed water to the refrigerant flowing through the refrigerant passages 45*c* (because of the operation of the compressor 10), the condensed water may not be easily frozen at once. Accordingly, even when the condensed water would remain in the air passages 4611 so as to fill them, it is possible to surely prevent the refrigerant tubes 45 and/or any other portions of the evaporator 40 from being deformed.

In addition, multiple convex portions 471 and the multiple concave portions 472 are formed in the cooling-storage containers 47. It is, therefore, possible not only to make the structure of the refrigerant tubes simpler but also to make the surface area of the cooling-storage container 47 larger. As a result, the air cooling performance is improved in the cooling operation of the air conditioning apparatus, in which the cold energy is discharged from the cooling-storage material.

Although not shown in the drawings, in a case that a thermistor for detecting temperature of the air-side fins 46 is provided, it may be preferably provided at such a portion above the line AA.

(Second Embodiment)

A second embodiment of the present disclosure will be explained with reference to FIG. 14. The second embodiment differs from the first embodiment in that an inner fin is extended in the inside of the cooling-storage container 47 to such a point, which is below the line AA. The same reference numerals to the first embodiment are used in the second embodiment for the purpose of designating the same or similar parts and/or the components.

Figure 14:
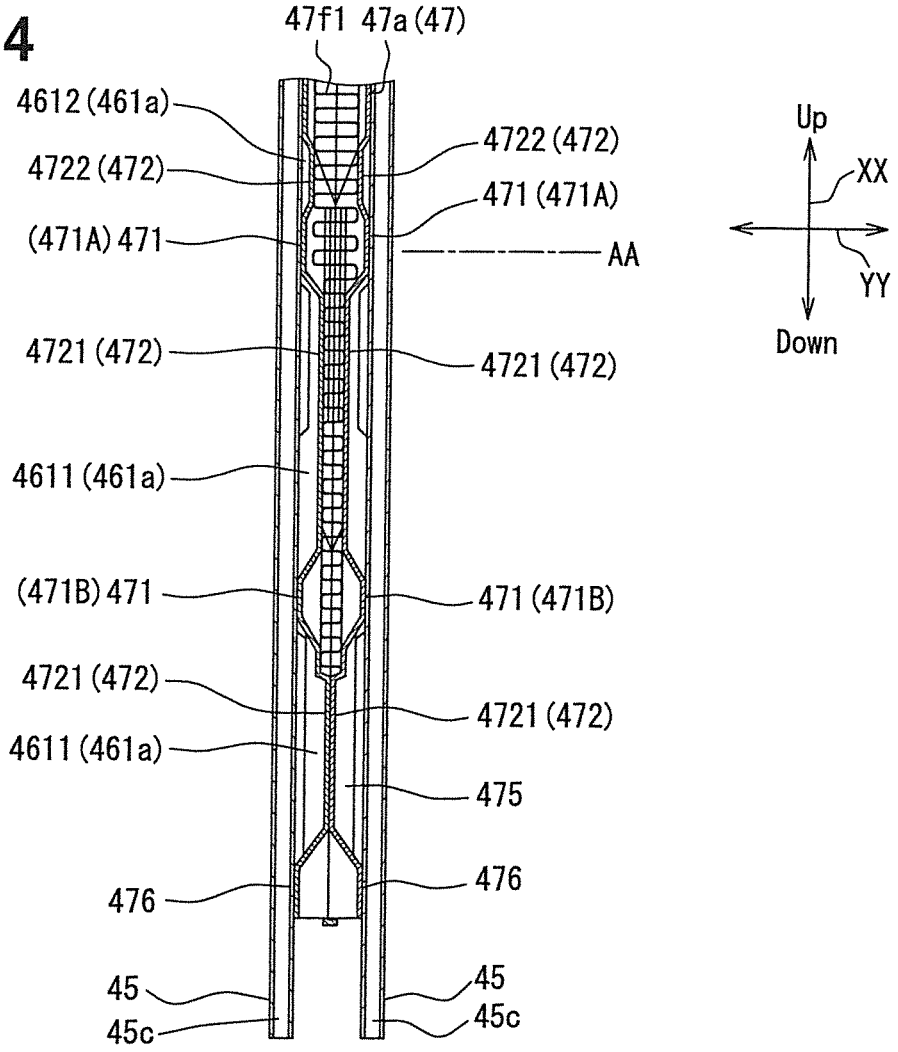
FIG. 14 is a schematic cross sectional view (in a longitudinal direction) showing a relevant portion of a cooling-storage container 47 according to a second embodiment.

FIG. 14 is a cross sectional view corresponding to that of FIG. 7 for the first embodiment. As shown in FIG. 14, an inner fin 47*f*1 is arranged in the inside of the outer envelope portions 47*a* of the cooling-storage container 47. The inner fin 47*f*1 extends from a position above the line AA to a position below the line AA. The inner fin 47*f*1 is made of a thin metal plate (such as, aluminum) and formed in a wave shape. A lower portion of the inner fin 47*f*1, which is arranged in the lower portion of the cooling-storage container 47 below the line AA, has a height of the wave shape (the depth dimension in the YY direction) smaller than that of an upper portion of the inner fin 47*f*1 above the line AA.

The inner fin 47*f*1 is thermally and mechanically connected to the cooling-storage container 47, for example, by soldering. In the upper portion of the cooling-storage container 47 above the line AA, the bottom portions of the concave portions 4722 (which are opposing to each other in the YY direction) are connected to each other via the upper portion of the inner fin 47*f*1. In the lower portion of the cooling-storage container 47 below the line AA, between the lower-most convex portion 471A and the lower-side convex portion 471B, the bottom portions of the concave portions 4721 (which are opposing to each other in the YY direction) are likewise connected to each other via the lower portion of the inner fin 47*f*1. The remaining portions of the concave portions 4721 (that is, the lower-most portions below the lower-side convex portion 471B) are directly connected to each other without the inner fin 47*f*1.

The inner fin 47*f*1 is extended in the downward direction at least to a lower side of the lower-side convex portion 471B (that is, an upper side of the lower-most concave portion 472).

Since the bottom portions of the concave portions 472 are connected to each other via the inner fin 47*f*1, any deformation of the cooling-storage container 47 is prevented to thereby increase the pressure resistance. In addition, since not only in the upper portion but also in the lower portion of the cooling-storage container 47, the inner fin 47*f*1 is fixed to the inner surfaces of the outer envelope portions 47*a* of the cooling-storage container 47, the transfer of the cold energy from the refrigerant to the cooling-storage material 50 in the cold-energy storing process as well as the transfer of the cold energy from the cooling-storage material 50 to the air in the cold-energy discharging process can be more easily done.

(Further Modifications)

Some of the embodiments of the present disclosure are explained as above. However, the present disclosure should not be limited to such embodiments, but the present disclosure can be modified in various manners without departing from the spirit thereof.

Water-guide grooves may be formed in the water-guide walls 474 for the cooling-storage container 47, so that the condensed water can be stably guided in the downward direction. When the water-guide grooves are formed, the condensed water can be much more easily guided in the downward direction along such grooves formed in the water-guide walls 474.

Figure 15:
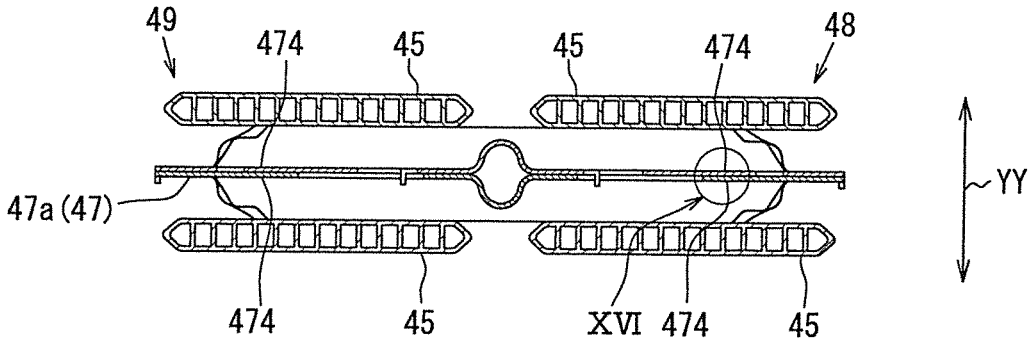
FIG. 15 is a schematic cross sectional view showing a relevant portion of a modification of the present disclosure.
Figure 16:
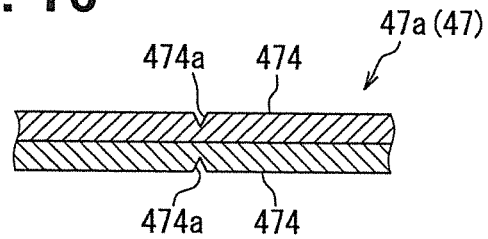
FIG. 16 is a schematically enlarged sectional view showing a portion XVI in FIG. 15.

As shown in FIG. 16, water-guide grooves 474*a*, its cross section has a triangular shape, may be formed in the water-guide walls 474, wherein the water-guide grooves 474*a* extend in the vertical direction (the XX direction). FIG. 16 is an enlarged view showing a portion XVI of the cooling-storage container 47 indicated in FIG. 15, which corresponds to the cross sectional view of FIG. 10 for the first embodiment.

Figure 17:
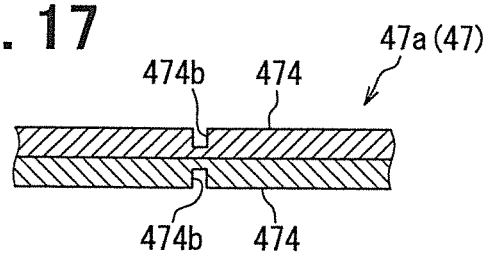
FIG. 17 is a schematically enlarged sectional view showing a relevant portion of another modification of the present disclosure.
Figure 18:
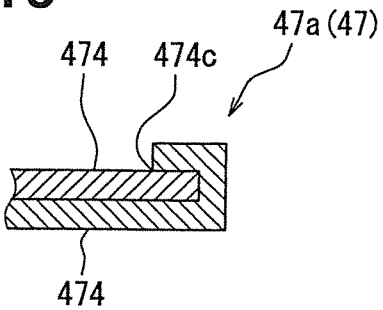
FIG. 18 is a schematically enlarged sectional view showing a relevant portion of a further modification of the present disclosure.

A cross sectional shape of the water-guide groove should not be limited to the triangular shape. For example, as shown in FIG. 17, a water-guide groove 474*b* having a rectangular shape in its cross section may be formed.

The water-guide groove may be formed in various methods. For example, the water-guide groove may be formed by plastic forming, removing work and so on. In the first embodiment, the cooling-storage container 47 is made of the pair of metal plates, which are shaped by press work and which are connected to each other. For example, the two metal plates are connected in such a manner that an outer periphery of one metal plate is bent to wrap an outer periphery of the other metal plate and such bent portion is firmly pressed. A step portion 474*c* is formed at such bent portion and the step portion 474*c* may be used as the water-guide groove.

In the above embodiments, some of the concave portions 472 (4721) are formed in the lower portion of the cooling-storage container 47 below the line AA, wherein the width dimension (the dimension in the XX direction) as well as the depth dimension (the dimension in the YY direction) of the lower-side concave portions 4721 is made larger than that of the upper-side concave portions 4722. According to such structure, the sectional area of the lower-side air passages 4611 (the air passages 461*a* below the line AA) is made larger than that of the upper-side air passages 4612 (the air passages 461*a* above the line AA).

The present disclosure should not be limited to the above structure. For example, one of the width dimension and the depth dimension of the concave portions 472 below the line AA may be made larger than that of the concave portions 472 above the line AA, so that the sectional area of the lower-side air passages 4611 (below the line AA) is made larger than that of the upper-side air passages 4612 (above the line AA).

In the above embodiments, the opening portions 473 are formed so as to reduce the direct contacting area between the bottom portions of the respective concave portions 4721. Notched portions may be formed instead of the opening portions 473.

In addition, in the above embodiments, the opening portions 473 are formed in the bottom portions of the both-side concave portions 4721 opposing to each other. However, the opening portions and/or notched portions may be formed in the bottom portions of one-side concave portions 4721.

Figure 19A:
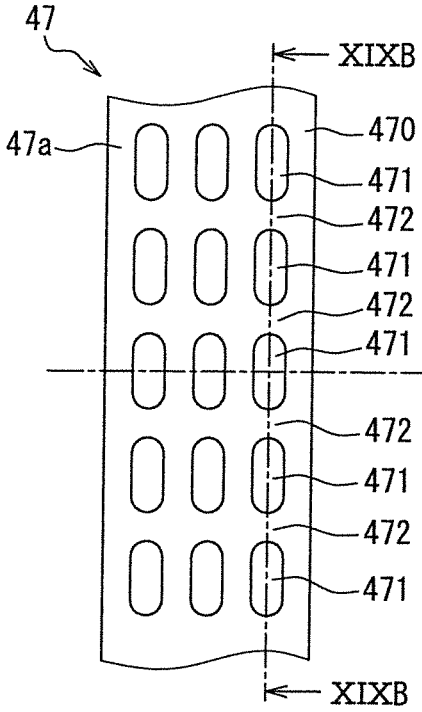
FIG. 19A is a schematic front view showing a portion of a cooling-storage container according to a further modification of the present disclosure.
Figure 19B:
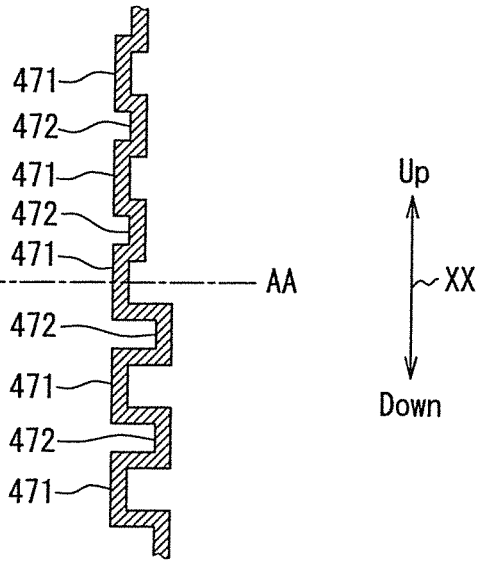
FIG. 19B is a schematic cross sectional view taken along a line XIXB-XIXB in FIG. 19A.
Figure 20A:
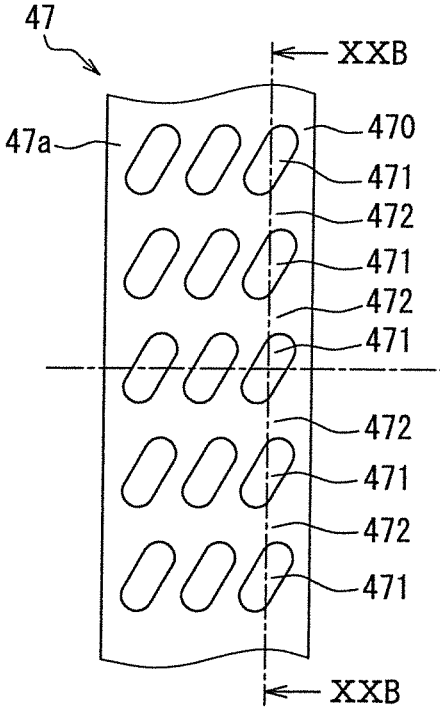
FIG. 20A is a schematic front view showing a portion of a cooling-storage container according to a still further modification of the present disclosure.
Figure 20B:
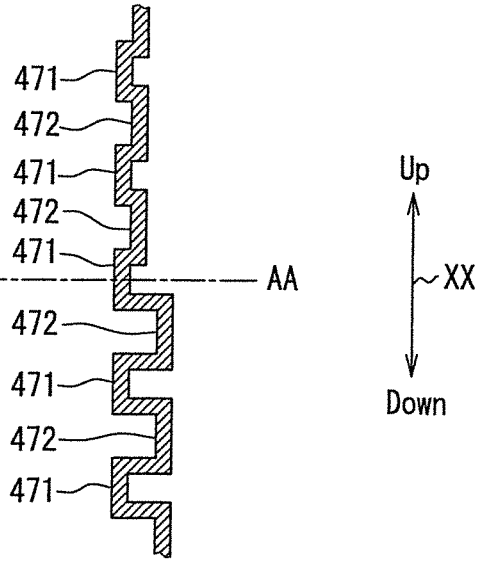
FIG. 20B is a schematic cross sectional view taken along a line XXB-XXB in FIG. 20A.

In addition, in the above embodiments, the convex portions 471 are formed in the reversed V-shape. However, as shown in FIGS. 19A and 19B, the convex portions 471 may be formed in an oval shape. A longitudinal direction of the oval shape should not be limited to the vertical direction. For example, as shown in FIGS. 20A and 20B, the convex portions 471 of the oval shape may be inclined with respect to the vertical direction, wherein all of the convex portions 471 are inclined in the same direction.

Figure 21A:
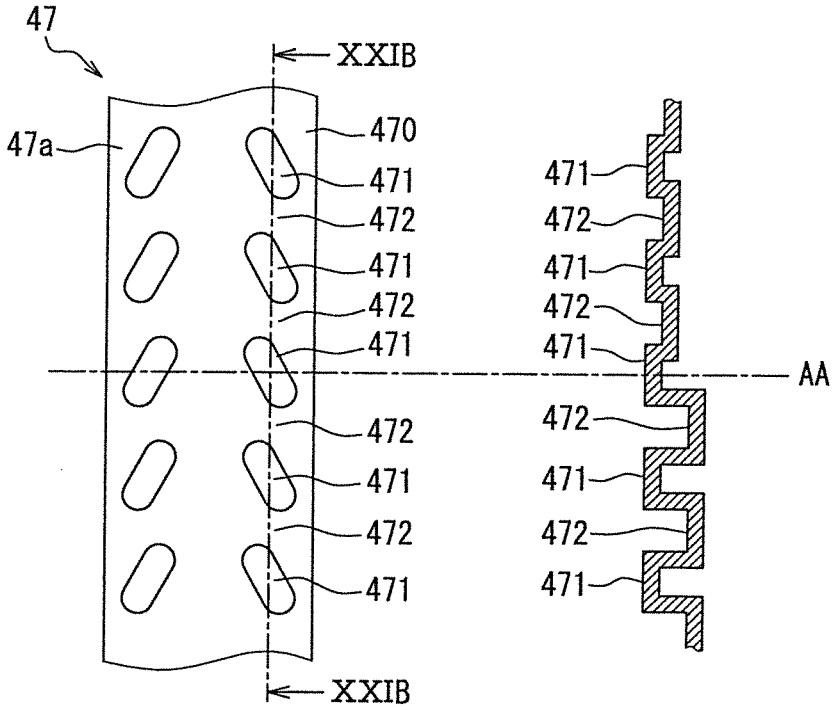
FIG. 21A is a schematic front view showing a portion of a cooling-storage container according to a still further modification of the present disclosure.
Figure 21B:
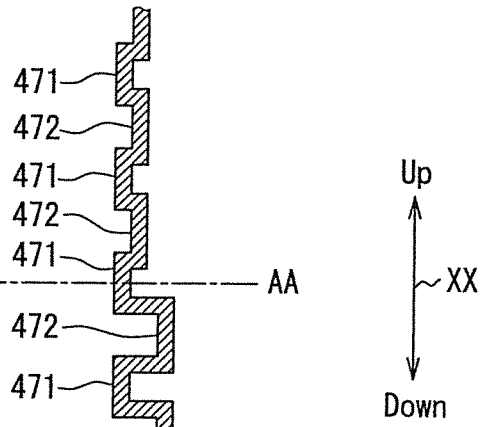
FIG. 21B is a schematic cross sectional view taken along a line XXIB-XXIB in FIG. 21A.
Figure 22A:
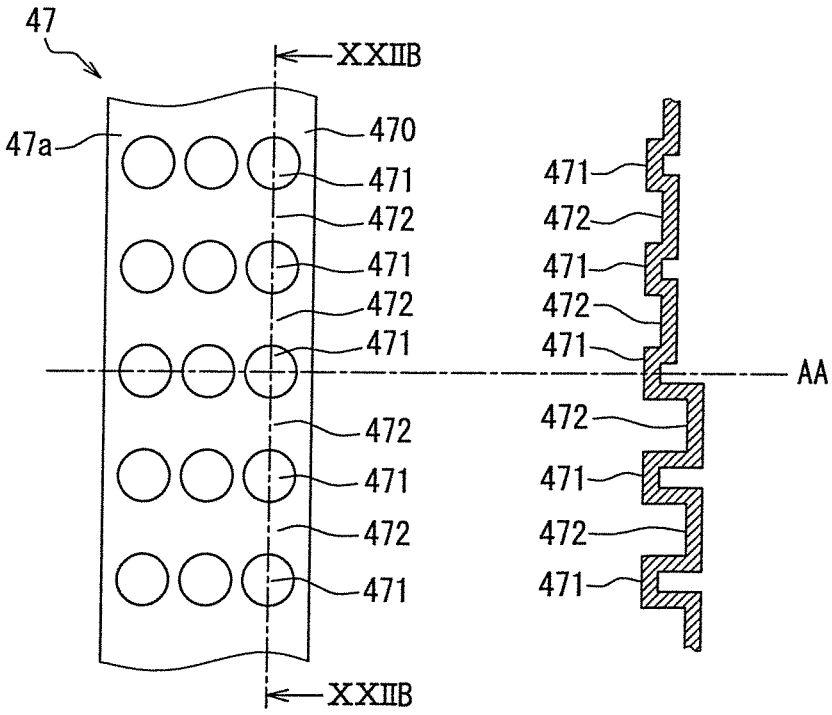
FIG. 22A is a schematic front view showing a portion of a cooling-storage container according to a still further modification of the present disclosure.
Figure 22B:
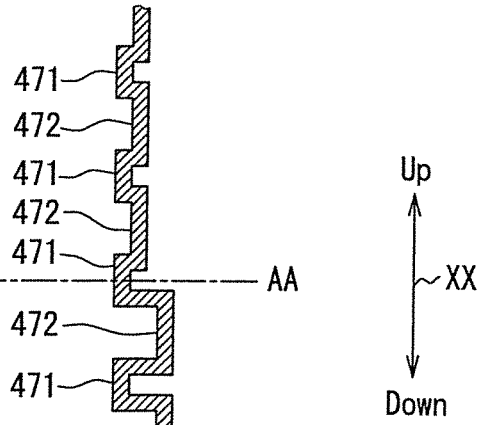
FIG. 22B is a schematic cross sectional view taken along a line XXIIB-XXIIB in FIG. 22A.

As shown in FIGS. 21A and 21B, the directions of the oval shape may be different. For example, the convex portions 471 of the oval shape which are arranged in an upstream side of the air flow (that is, the left-hand side in the drawing) are inclined in a going-up direction, while the convex portions 471 in a downstream side are inclined in a going-down direction. Furthermore, the convex portions 471 may be formed in a circular shape.

In the above embodiment, the multiple convex portions 471 and the multiple concave portions 472 are alternately formed in the side wall 470 of the cooling-storage container 47. However, the present disclosure should not be limited to this structure. For example, the multiple convex portions and concave portions may be formed in the side wall of the refrigerant tube 45, or may be formed in the side walls of both the cooling-storage container 47 and the refrigerant tube 45.

What is claimed is:

1. A cooling-storage type heat exchanger comprising:

a first and a second header tanks;

multiple refrigerant tubes extending in a vertical direction, each of which has a refrigerant passage, wherein the refrigerant tubes are arranged at distances in a tube-arrangement direction and between the first and second header tanks, so that refrigerant flows through the refrigerant passage at least from one of the first and second header tanks to the other header tank;

a cooling-storage container having a cooling-storage material therein and arranged between neighboring refrigerant tubes, wherein a side wall of the cooling-storage container is opposing to a side wall of the refrigerant tube in the tube-arrangement direction; and multiple convex portions outwardly projecting and multiple concave portions inwardly projecting, which are formed in the side wall of the refrigerant tube and/or the cooling-storage container and which are alternately arranged in the vertical direction, wherein the refrigerant tubes are jointed to the cooling-storage container at such first portions at which the convex portions are formed, while the refrigerant tubes are separated from the cooling-storage container at such second portions at which the concave portions are formed, so that air passages are formed at the second portions through which outside air passes between the refrigerant tubes and the cooling-storage container, and wherein a sectional area of the air passage, which is formed in a lower portion of the cooling-storage container below a predetermined height in the vertical direction and between the refrigerant tubes and the cooling-storage container, is made larger than that of the air passage, which is formed in an upper portion of the cooling-storage container above the predetermined height in the vertical direction and between the refrigerant tubes and the cooling-storage container.

2. The cooling-storage type heat exchanger according to claim 1, wherein a depth dimension in the tube-arrangement direction of the concave portion, which is formed in a lower portion of the side wall of the cooling-storage container and/or the refrigerant tube below the predetermined height, is made larger than that of the concave portion, which is formed in an upper portion of the cooling-storage container and/or the refrigerant tube above the predetermined height.

3. The cooling-storage type heat exchanger according to claim 2, wherein both of the multiple convex portions and the multiple concave portions are formed in the side wall of the cooling-storage container.

4. The cooling-storage type heat exchanger according to claim 3, wherein the cooling-storage container is composed of a pair of outer envelope portions which are fixed to each other, each of the outer envelope portions forms the side wall of the cooling-storage container and opposes to each other in the tube-arrangement direction, and bottom portions of the concave portions which are formed in the lower portions of the respective side walls of the cooling-storage container below the predetermined height are directly fixed to each other.

5. The cooling-storage type heat exchanger according to claim 4, wherein an inner fin is provided in an inside of the cooling-storage container, and bottom portions of the concave portions which are formed in the upper portions of the respective side walls of the cooling-storage container above the predetermined height are fixed to each other via the inner fin.

6. The cooling-storage type heat exchanger according to claim 4, wherein an opening portion or a notched portion is formed in the bottom portion of the concave portion which is formed in the lower portion of the side wall below the predetermined height.

7. The cooling-storage type heat exchanger according to claim 3, wherein the side wall of the cooling-storage container has a water-guide wall, which extends from a lower side of the convex portion in a downward direction, so that condensed water generated on an outer surface of the air passage is guided in the downward direction.

8. The cooling-storage type heat exchanger according to claim 7, wherein a water-guide groove is formed in the water-guide wall for guiding the condensed water in the downward direction.

9. The cooling-storage type heat exchanger according to claim 3, further comprising:

a first heat exchanger portion being composed of the multiple refrigerant tubes; and a second heat exchanger portion being composed of the multiple refrigerant tubes, the second heat exchanger portion being separated from the first heat exchanger portion at a predetermined distance but arranged at an upstream side of the first heat exchanger portion in a flow direction of the outside air, which passes through the second and first heat exchanger portions, wherein the cooling-storage container extends from the second heat exchanger portion to the first heat exchanger portion in the flow direction of the outside air, so that, an upstream portion of the cooling-storage container is arranged between the refrigerant tubes of the second heat exchanger portion while a downstream portion of the cooling-storage container is arranged between the refrigerant tubes of the first heat exchanger portion, and wherein a center projection is formed in the lower portion of the side wall of the cooling-storage container below the predetermined height, the center projection being projected toward a space formed between the refrigerant tube of the first heat exchanger portion and the refrigerant tube of the second heat exchanger portion so as to suppress the air flow of the outside air passing through the air passage formed in the lower portion of the cooling-storage container below the predetermined height and between the refrigerant tubes and the cooling-storage container.

10. The cooling-storage type heat exchanger according to claim 3, further comprising:

a lower-end projection formed in each of the side walls of the cooling-storage container at a lower-most end thereof, which is below a lower-side convex portion formed in the lower portion of the cooling-storage container, wherein the side walls are opposed to each other in the tube-arrangement direction, and wherein a forward end of the lower-end projection is outwardly projected in the tube-arrangement direction and in contact with the refrigerant tube, so as to suppress a bending of the refrigerant tube toward the cooling-storage container.

* * * * *